US010876782B2

(12) United States Patent
Zhang

(10) Patent No.: US 10,876,782 B2
(45) Date of Patent: Dec. 29, 2020

(54) AIR CHANNEL ASSEMBLY AND REFRIGERATOR HAVING SAME

(71) Applicants: HEFEI MIDEA REFRIGERATOR CO., LTD., Anhui (CN); MIDEA GROUP CO., LTD., Guangdong (CN)

(72) Inventor: Libin Zhang, Anhui (CN)

(73) Assignees: HEFEI MIDEA REFRIGERATOR CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 540 days.

(21) Appl. No.: 15/796,589

(22) Filed: Oct. 27, 2017

(65) Prior Publication Data

US 2018/0051924 A1 Feb. 22, 2018

Related U.S. Application Data

(63) Continuation of application No. PCT/CN2015/081492, filed on Jun. 15, 2015.

(30) Foreign Application Priority Data

Apr. 30, 2015 (CN) ..... 2015 1 0222134
Apr. 30, 2015 (CN) ..... 2015 2 0281957 U

(51) Int. Cl.
*A47J 47/00* (2006.01)
*E04H 7/22* (2006.01)
(Continued)

(52) U.S. Cl.
CPC ..... *F25D 17/065* (2013.01); *F25D 17/062* (2013.01); *F25D 21/14* (2013.01);
(Continued)

(58) Field of Classification Search
CPC ..... F25D 17/062; F25D 21/14; F25D 25/025; F25D 2317/063; F25D 2317/067; F25D 2321/142
(Continued)

(56) References Cited

U.S. PATENT DOCUMENTS 7,266,958 B2 9/2007 Milde et al.
9,327,874 B2 * 5/2016 Hawley, III ..... B65D 25/38

FOREIGN PATENT DOCUMENTS

CN 101614461 A 12/2009
CN 102287988 A 12/2011
(Continued)

OTHER PUBLICATIONS

Hefei Midea Refrigerator Co., Ltd., Hefei Midea Refrigerator Co., Ltd. Extended European Search Report, EP15890476.3, dated Nov. 6, 2018, 8 pgs.
(Continued)

*Primary Examiner* — Helena Kosanovic
(74) *Attorney, Agent, or Firm* — Morgan, Lewis & Bockius LLP

(57) ABSTRACT

An air channel assembly (100) and a refrigerator (200) having the same are provided. The air channel assembly (100) includes: a casing (10) provided with an air supply channel (11) and a drainage port (14) therein. The air supply channel (11) has an air inlet (12) and a bottom air supply port (13). An air-supply guide portion (15) configured to lead air to the bottom air supply port (13) and a drainage guide portion (16) configured to lead water to the drainage port (14) are provided adjacent to the bottom air supply port (13). A guide direction of the air-supply guide portion (15) is opposite to a guide direction of the drainage guide portion (16).

9 Claims, 5 Drawing Sheets

(51) Int. Cl.
*F25D 17/06* (2006.01)
*F25D 21/14* (2006.01)
*F25D 25/02* (2006.01)

(52) U.S. Cl.
CPC ..... *F25D 25/025* (2013.01); *F25D 2317/063* (2013.01); *F25D 2317/067* (2013.01); *F25D 2321/142* (2013.01)

(58) Field of Classification Search
USPC ..... 454/183
See application file for complete search history.

(56) References Cited

FOREIGN PATENT DOCUMENTS

| | | | |
|---|---|---|---|
| CN | 202361734 | U | 8/2012 |
| CN | 202393158 | U | 8/2012 |
| CN | 202692580 | U | 1/2013 |
| CN | 202770109 | U | 3/2013 |
| CN | 203704507 | U | 7/2014 |
| CN | 104457096 | A | 3/2015 |
| CN | 204718241 | U | 10/2015 |
| DE | 19500369 | A1 | 7/1996 |
| FR | 321682 | A | 1/1903 |
| JP | H10238933 | A | 9/1998 |
| JP | 2007071487 | A | 3/2007 |
| KR | 100333621 | B1 | 4/2002 |
| KR | 20140019595 | A | 2/2014 |

OTHER PUBLICATIONS

Hefei Midea Refrigerator Co., Ltd. First Office Action, CN201510222134.2, dated Jan. 4, 2017, 16 pgs.
Hefei Midea Refrigerator Co., Ltd., International Search Report and Written Opinion, PCTCN2015081492, dated Jan. 25, 2016, 19 pgs.

* cited by examiner

AIR CHANNEL ASSEMBLY AND REFRIGERATOR HAVING SAME

CROSS-REFERENCE TO RELATED APPLICATION

This application is a continuation application of PCT Patent Application No. PCT/CN2015/081492, entitled "AIR CHANNEL ASSEMBLY AND REFRIGERATOR HAVING SAME" filed on Jun. 15, 2015, which claims priority to and benefits of Chinese Patent Application No. 201510222134.2, entitled "AIR CHANNEL ASSEMBLY AND REFRIGERATOR HAVING SAME" filed on Apr. 30, 2015, and Chinese Patent Application No. 201520281957.8, entitled "AIR CHANNEL ASSEMBLY AND REFRIGERATOR HAVING SAME" filed on Apr. 30, 2015, the entire contents of all of which are incorporated herein by reference.

TECHNICAL FIELD

The present disclosure relates to a technical field of refrigeration, and specifically to an air channel assembly and a refrigerator having the same.

BACKGROUND

In the related art, water vapor inside an air channel of an air-cooled refrigerator condenses to water which flows down, and the water is discharged out through a bottom air supply port at the bottom of an air channel of a freezing chamber and finally concentrated near a drawer at the bottom of the freezing chamber and freezes, which not only brings the trouble of cleaning the ice to the user, but also increases the energy consumptions greatly and brings down operation efficiency of the refrigerator due to icing for a long time.

SUMMARY

The present disclosure seeks to solve one of the technical problems existing in the related art to at least some extent.

Accordingly, the present disclosure needs to provide an air channel assembly, which has a less loss of air volume, and can drain water effectively and prevent frosting.

The present disclosure also provides a refrigerator having the air channel assembly.

The air channel assembly provided by the present disclosure includes: a casing provided with an air supply channel and a drainage port therein, the air supply channel having an air inlet and a bottom air supply port, an air-supply guide portion configured to lead air to the bottom air supply port and a drainage guide portion configured to lead water to the drainage port being provided adjacent to the bottom air supply port, a guide direction of the air-supply guide portion being opposite to a guide direction of the drainage guide portion.

The air channel assembly according to embodiments of the present disclosure not only has a less loss of air volume, but can also drain water effectively and prevent frosting.

In addition, the air channel assembly according to the above-mentioned embodiments may have the additional technical features as follows.

According to an example of the present disclosure, the air-supply guide portion includes: a first air-supply guide section connected to the air supply channel; and a second air-supply guide section spaced apart from the first air-supply guide section and being consistent with the first air-supply guide section in their respective air-supply guide directions, the drainage guide portion being located between the first air-supply guide section and the second air-supply guide section and a guide direction of the drainage guide portion being opposite to the guide direction of the first air-supply guide section.

According to an example of the present disclosure, the drainage guide portion includes: a first drainage guide section connected to the first air-supply guide section; and a second drainage guide section connected to the second air-supply guide section and located below the first drainage guide section.

According to an example of the present disclosure, the second air-supply guide section gradually inclines downward from rear to front, and the second drainage guide section gradually inclines downward from front to rear.

According to an example of the present disclosure, the drainage port is defined in the first drainage guide section, and the bottom air supply port is defined above the second air-supply guide section and opposite to the second air-supply guide section.

According to an example of the present disclosure, the air channel assembly further includes an auxiliary guide portion arranged on the second drainage guide section and having a groove, the groove being arranged adjacent to the drainage port so as to gather the water to the drainage port.

According to an example of the present disclosure, a gap exists between a lower end of the first drainage guide section and the second drainage guide section.

According to an example of the present disclosure, projections of a front side face of the first air-supply guide section and a front side face of a terminal end of the air supply channel in a vertical direction fall onto the second drainage guide section.

According to an example of the present disclosure, a projection of a terminal end of the first drainage guide section on the second drainage guide section is adjacent to a front side of the second drainage guide section.

The refrigerator provided in the present disclosure includes a freezing air channel assembly and/or a refrigerating air channel assembly, the freezing air channel assembly and/or the refrigerating air channel assembly is the above-mentioned air channel assembly.

Additional aspects and advantages of embodiments of present disclosure will be given in part in the following descriptions, become apparent in part from the following descriptions, or be learned from the practice of the embodiments of the present disclosure.

Figure 1:
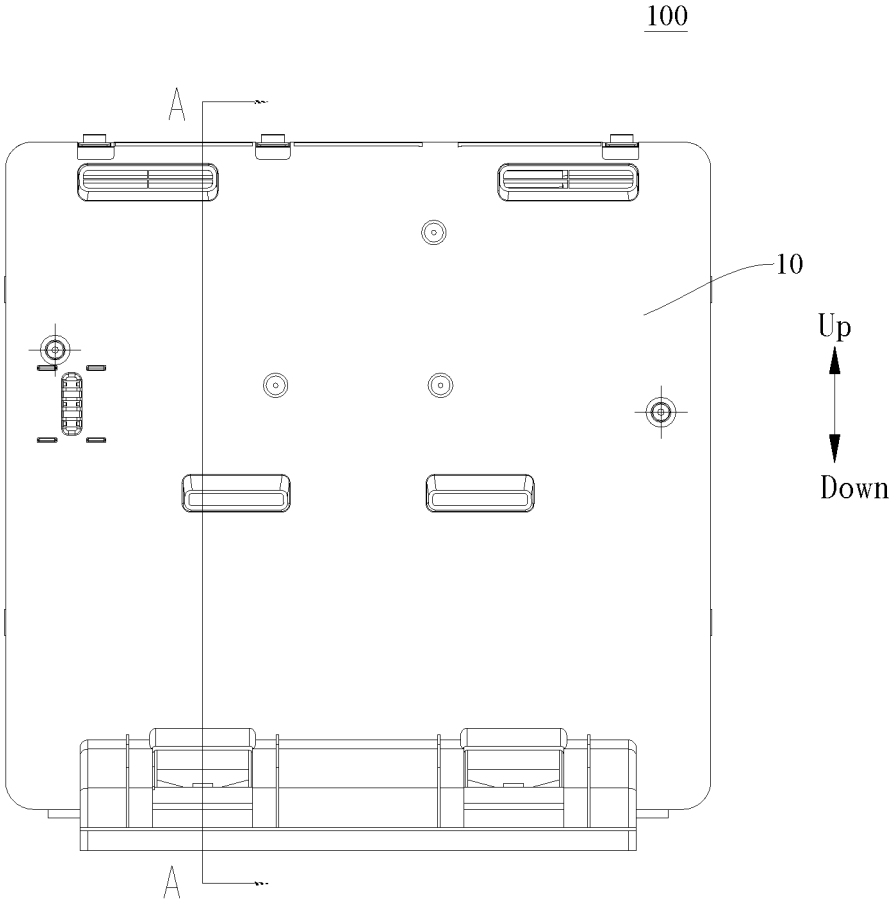
FIG. 1 is a schematic view of an air channel assembly according to embodiments of the present disclosure.

REFERENCE NUMERALS air channel assembly 100, refrigerator 200, evaporator 201, air return port 202, drawer 203, casing 10, front cover 10*a*, rear cover 10*b*, air supply channel 11, front side face 11*a* of terminal end of the air supply channel, air inlet 12, bottom air supply port 13, drainage port 14, air-supply guide portion 15, first air-supply guide section 151, front side face 151*a* of the first air-supply guide section, second air-supply guide section 152, drainage guide portion 16, first drainage guide section 161, second drainage guide section 162, auxiliary guide portion 17, groove 171, top air supply port 18, middle air supply port 19, fan 20.

DETAILED DESCRIPTION

The embodiments of the present disclosure will be described in detail in the following. The examples of the embodiments are illustrated in the accompanying drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals/and or letters may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

An air channel assembly 100 according to embodiments of the present disclosure will be described with reference to FIGS. 1 to 4 in the following.

Figure 2:
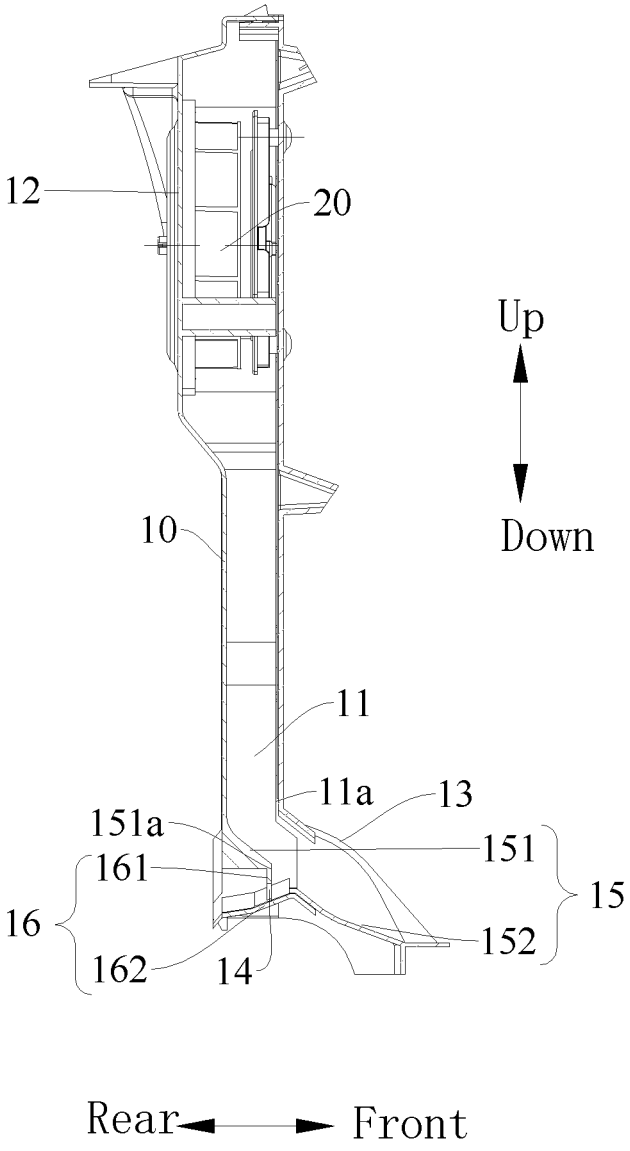
FIG. 2 is a sectional view along line A-A in FIG. 1.

As illustrated in FIGS. 1 and 2, the air channel assembly 100 according to embodiments of the first aspect of the present disclosure includes a casing 10 provided with an air supply channel 11 and a drainage port 14 therein, the air supply channel 11 has an air inlet 12 and a bottom air supply port 13, an air-supply guide portion 15 configured to lead air to the bottom air supply port 13 and a drainage guide portion 16 configured to lead water to the drainage port 14 are provided adjacent to the bottom air supply port 13, a guide direction of the air-supply guide portion 15 is away from a guide direction of the drainage guide portion 16.

In the air channel assembly 100 according to embodiments of the present disclosure, air enters through the air inlet 12 of the air supply channel 11, then flows in the air supply channel 11 and flows towards the bottom air supply port 13 under the guide function of the air-supply guide portion 15. Water vapor carried by the air in the air supply channel 11 condenses to water which flows downwardly in the air supply channel 11, and the water flows out through the drainage port 14 under a function of the drainage guide portion 16. As the guide direction of the air-supply guide portion 15 and the guide direction of the drainage guide portion 16 are away from each other, the air and the water are separated effectively near the bottom air supply port 13, not only an air volume loss resulted from too much air outflow through the drainage port 14 is reduced, but also icing at the bottom of the air channel assembly 100 resulted from drainage through the air supply port is prevented.

It is to be noted that the guide direction of the air-supply guide portion 15 and the guide direction of the drainage guide portion 16 are away from each other means that the guide direction of the air-supply guide portion 15 and the guide direction of the water supply guide portion are substantially away from each other. That is, the guide direction of the air-supply guide portion 15 and the guide direction of the drainage guide portion 16 are substantially opposite in a front-rear direction. For example, the guide direction of the air-supply guide portion 15 is in a forward-downward inclined direction, and the guide direction of drainage guide portion 16 is in a backward-downward inclined direction.

Figure 3:
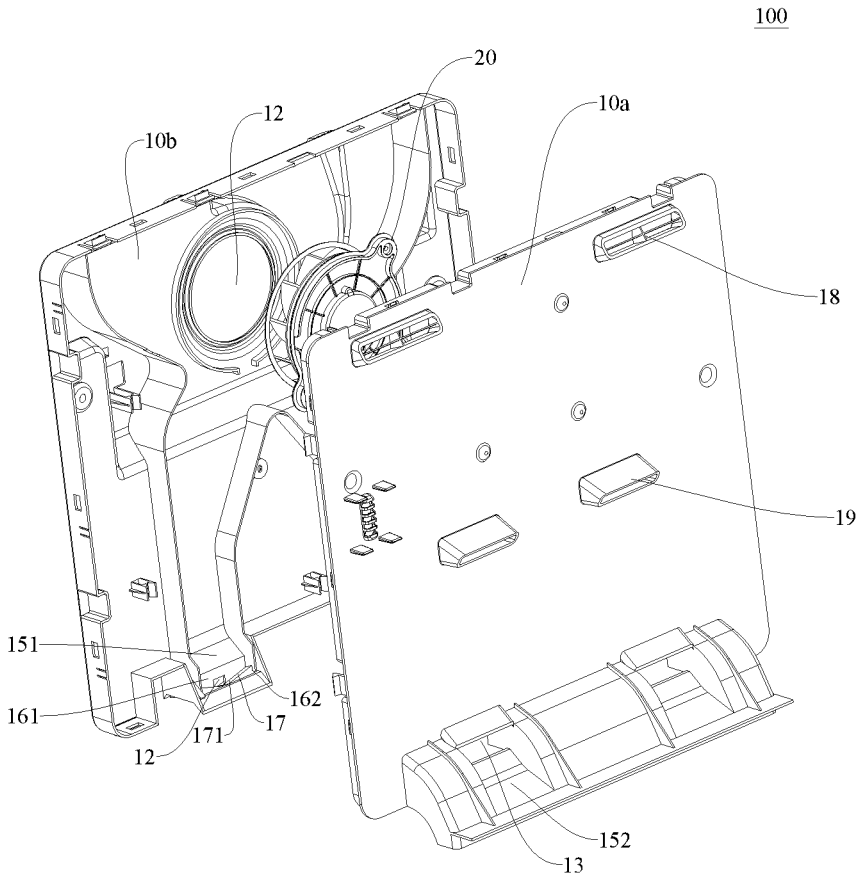
FIG. 3 is a perspective view of an air channel assembly according to embodiments of the present disclosure.

In the specific example illustrated in FIG. 3, the number of the air supply channel 11 is two. The two air supply channels 11 intersect and communicate with a same air inlet 12.

As illustrated in FIG. 2, preferably, the air-supply guide portion 15 includes a first air-supply guide section 151 and a second air-supply guide section 152. The first air-supply guide section 151 is connected to the air supply channel 11, the second air-supply guide section 152 is spaced apart from the first air-supply guide section 151 and consistent with the first air-supply guide section 151 in their respective air-supply guide directions. The drainage guide portion 16 is located between the first air-supply guide section 151 and the second air-supply guide section 152 and the guide direction of the drainage guide portion 16 is away from the guide direction of the first air-supply guide section 151. A certain height difference exits between the first drainage guide section 161 and the second drainage guide section 162 in a vertical direction, and the drainage guide section is arranged where the height difference exists. In this way, when the air and water flows downwards and passes through the first air-supply guide section 151, the air continues flowing to the second air-supply guide portion 15, and the water flows towards the drainage guide portion 16 where the height difference exists, thus a rapid separation of air and water in the air channel assembly 100 is realized.

It is to be noted that, the guide direction of the first air-supply guide section 151 and the guide direction of the second air-supply guide section 152 are consistent means that the guide direction of the first air-supply guide section 151 and the guide direction of the second air-supply guide section 152 are substantially consistent with each other. An included angle may exist between the guide directions of the two guide sections, but it is required to guarantee that the two guide sections are both away from the air supply guide section.

In a preferable embodiment, the drainage guide portion 16 includes a first drainage guide section 161 and a second drainage guide section 162. The first drainage guide section 161 is connected to the first air-supply guide section 151, and the second drainage guide section 162 is connected to the second air-supply guide section 152 and located below the first drainage guide section 161. Specifically, as illustrated in FIG. 2, the first drainage guide section 161 extends along the vertical direction, an upper end of the first drainage guide section 161 is connected to a lower end of the first air-supply guide section 151, an upper end of the second drainage guide section 162 is connected to an upper end of the second air-supply guide section 152, and the second drainage guide section 162 is located below the first drainage guide section 161. Thus, the air flowing out through the first air-supply guide section 151 is blown to the second air-supply guide section 152 and is discharged through the bottom air supply port 13. The water flowing out through the first air-supply guide section 151 falls down where the height difference between the first air-supply guide section 151 and the second air-supply guide section 152 is, then the water passes the first drainage guide section 161 and flows downwards, falls into the second drainage guide section 162 and is drained through the drainage port 14.

Further, the second air-supply guide section 152 gradually inclines downward from rear to front, and the second drainage guide section 162 gradually inclines downward from front to rear. As illustrated in FIG. 2, a rear end of the second air-supply guide section 152 is connected to a front end of the second drainage guide section 162, the second air-supply guide section 152 extends forward and inclines downward from a junction of the rear end of the second air-supply guide section 152 and the front end of the second drainage guide section 162, and the second drainage guide section 162 extends backward and inclines downward from the above-mentioned junction. Thus, the water flowing out through the first drainage guide section 161 passes the second drainage guide section 162 and flows out in a backward and downward direction, the air flowing out through the first air-supply guide section 151 passes the second air-supply guide section 152 and flows out along a forward and downward direction, so that the separation of air and water in the air supply channel 11 is realized, and the concentration of water at the bottom air supply port 13 is prevented.

As illustrated in FIG. 2, optionally, a gap exists between a lower end of the first drainage guide section 161 and the second drainage guide section 162, so that the water can be drained not only through the drainage port 14, but also through the gap formed between the first drainage guide section 161 and the second drainage guide section 162.

In some embodiments, as illustrated in FIG. 2, projections of a front side face 151*a* of the first air-supply guide section and a front side face 11*a* of a terminal end of the air supply channel in the vertical direction fall onto the second drainage guide section 162. Thus, all of the water flowing out through the air supply channel 11 and the first air-supply guide section 151 can fall into the second drainage guide section 162, which prevents the water from splashing on the second air-supply guide section 152, so that the icing resulted from concentration of the water (which cannot be discharged) at the bottom of the air channel assembly 100.

In the specific example illustrated in FIG. 2, a projection of a terminal end of the first drainage guide section 161 on the second drainage guide section 162 is adjacent to a front side of the second drainage guide section 162. Thus, water drops flowing out through the air supply channel 11 and the first drainage guide section 161 can be concentrated on the second drainage guide section 162, so that residual water drops on the second drainage guide section 162 is reduced.

As illustrated in FIG. 3, preferably, the drainage port 14 is defined in the first drainage guide section 161. Specifically, the first drainage guide section 161 has the drainage port 14, and a drainage direction of the drainage port 14 is from the front to the rear. In this way, a part of the water flowing down through the first drainage guide section 161 flows out directly through the drainage port 14, and another part of the water falls onto the second drainage guide section 162 and finally flows out through the drainage port 14, thus enhancing the drainage effect of the drainage port 14.

In combination with FIGS. 2 and 3, advantageously, the bottom air supply port 13 is defined above the second air-supply guide section 152 and opposite to the second air-supply guide section 152. In this way, the air is supplied from the rear to the upper front by means of the bottom air supply port 13, so that the air flowing through the second air-supply guide section 152 can be discharged out towards the bottom air supply port 13 rapidly and stably.

As illustrated in FIG. 3, in a preferable embodiment, the air channel assembly 100 further includes an auxiliary guide portion 17, the auxiliary guide portion 17 is arranged at the second drainage guide section 162 and has a groove 171. The groove 171 is arranged adjacent to the drainage port 14 so as to gather the water to the drainage port 14. Thus, the water falling onto the first drainage guide section 161 is gathered from an edge of the groove 171 to a center and flows below the drainage port 14, thus preventing the water from remaining on the drainage guide portion 16.

As illustrated in FIG. 3, the casing 10 may include a front cover 10*a* and a rear cover 10*b*. The front cover 10*a* is provided with a top air supply port 18 and a middle air supply port 19. The top air supply port 18 is configured to supply air to an internal top portion of a cabinet of the refrigerator, the middle air supply port 19 is configured to supply air to a middle portion of the cabinet of the refrigerator, and the bottom air supply port 13 is configured to supply air to the internal bottom portion of the cabinet. With this kind of design, the air supply efficiency can be improved and the temperature inside the cabinet is made more uniform.

Figure 4:
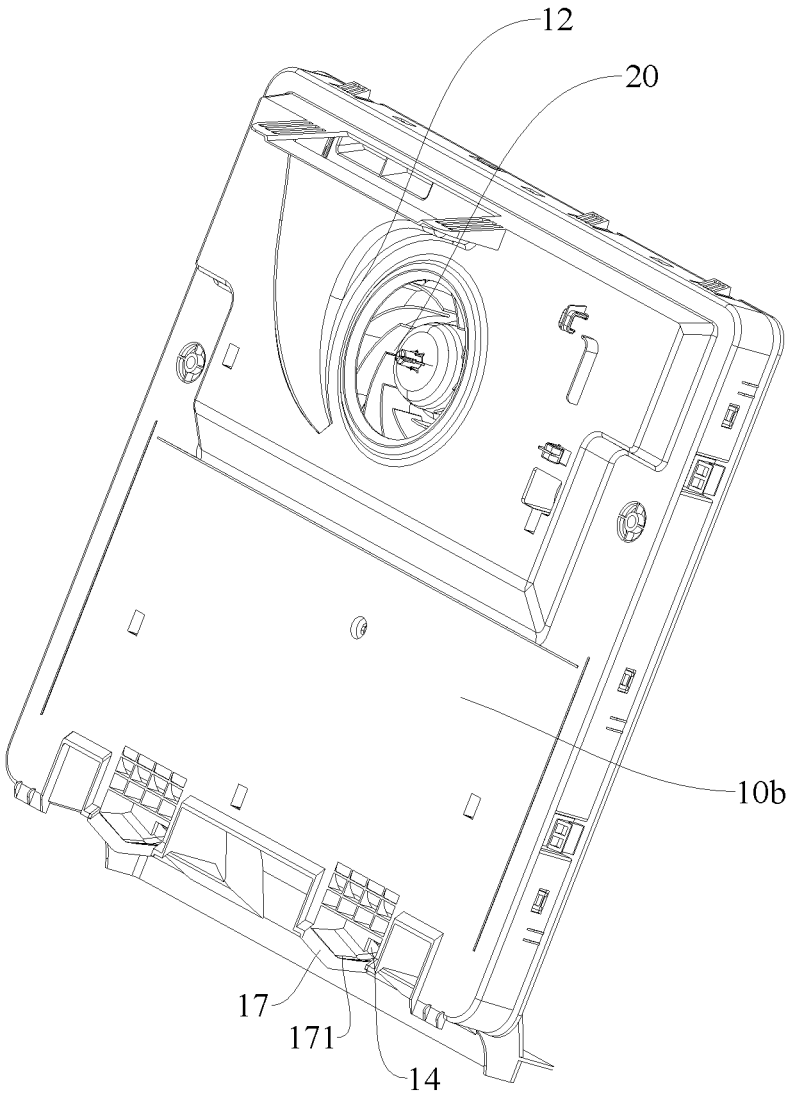
FIG. 4 is a schematic view of a front cover of a casing of an air channel assembly according to embodiments of the present disclosure.

In addition, as illustrated in FIG. 4, the air channel assembly 100 further includes a fan 20, the fan 20 is fastened to the front cover 10*a*, and the rear cover 10*b* is provided with an air inlet 12 corresponding to the fan 20 so as to lead the air cooled by the evaporator 201 into the air supply channel 11. Usually, a water containing tray is provided below the air channel assembly 100, and the water containing tray is disposed adjacent to the rear cover of the air channel assembly so as to collect and process the water flowing out from the air channel assembly 100.

Figure 5:
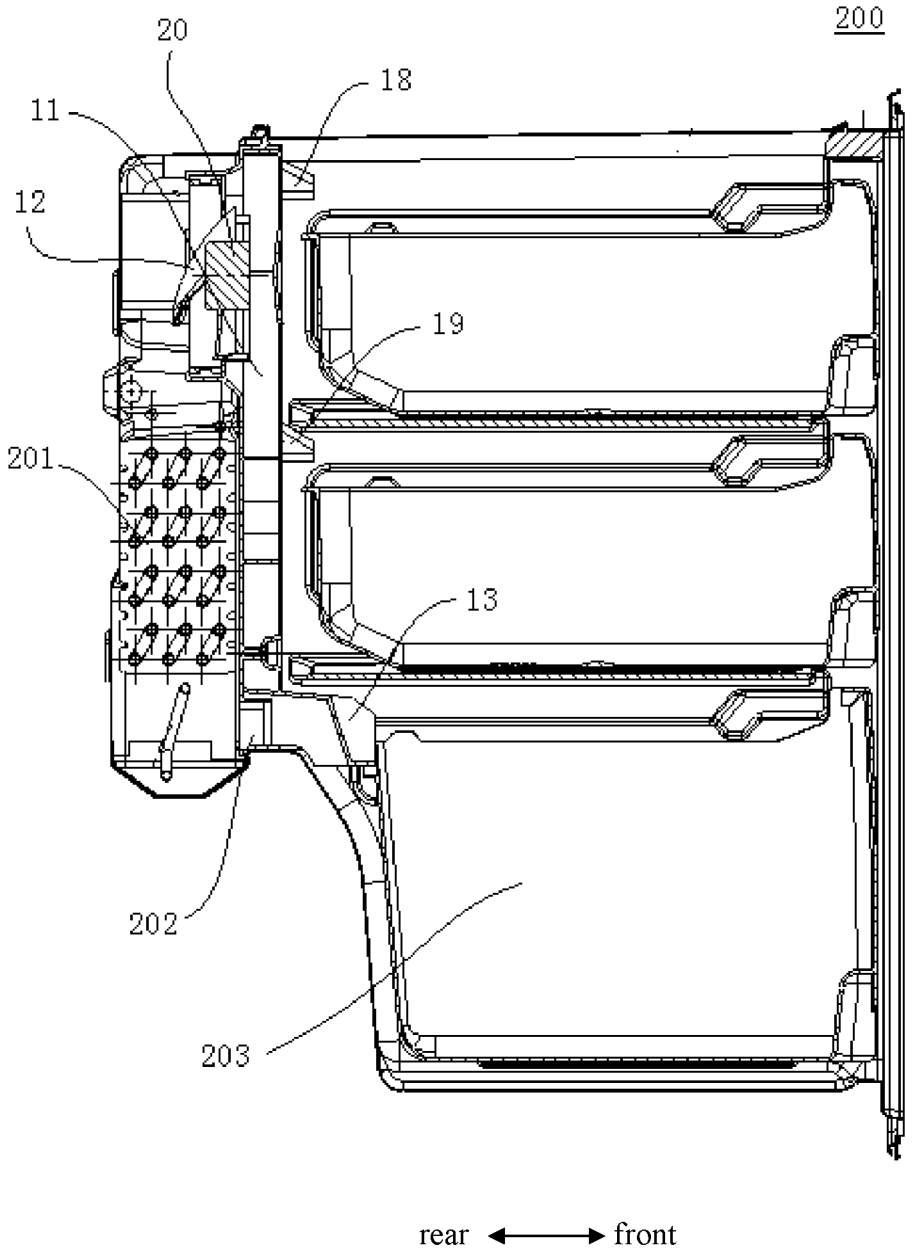
FIG. 5 is a partial schematic view of a refrigerator according to embodiments of the present disclosure.

The refrigerator 200 according to embodiments of the present disclosure is described with reference to FIG. 5 in the following.

The refrigerator 200 according to embodiments of the second aspect of the present disclosure includes a freezing air channel assembly 100 and/or a refrigerating air channel assembly 100. The freezing air channel assembly 100 and/or the refrigerating air channel assembly 100 are/is the air channel assembly 100. The air channel assembly, being the air channel assembly in a refrigerating chamber, is taken as an example to describe, as illustrated in FIG. 5, the air channel assembly is the air channel assembly in the refrigerating chamber, the evaporator 201 is arranged adjacent to the rear cover 10*b* of the air channel assembly 100, and the refrigerating chamber or a freezing chamber is arranged adjacent to the front cover 10*a*. The rear cover 10*b* has the air inlet 12 so as to lead cooled air cooled by the evaporator 201 into the air supply channel 11. An air return port 202 is defined below the casing 10, warm air flowing out from the drawer 203 is discharged out through the air return port 202, and the warm air flows towards the evaporator 201 and forms the cooled air after heat exchange by mean of the evaporator 201 under the action of suction force of the fan 20. A temperature reduction in the refrigerating chamber and/or the freezing chamber of the refrigerator 200 is realized with such cycles.

Other configurations such as a condenser and operations of the refrigerator 200 according to embodiments of the present disclosure are known to those ordinarily skilled in the art, which will not be elaborated here.

In the specification, it is to be understood that terms such as "central," "upper," "lower," "vertical," "horizontal," "top," "bottom," "inner," "outer," "axial direction," "radial direction," and "circumferential direction" should be construed to refer to the orientation as then described or as shown in the drawings under discussion. These relative terms are for convenience of description and do not require that the present disclosure be constructed or operated in a particular orientation, thus cannot be construed to limit the present disclosure.

In addition, terms such as "first" and "second" are used herein for purposes of description and are not intended to indicate or imply relative importance or significance or to imply the number of indicated technical features. Thus, the features defined with "first" and "second" may explicitly or implicitly comprise one or more of this feature. In the description of the present disclosure, the term "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements or interaction relationship of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases throughout this specification are not necessarily referring to the same embodiment or example. Furthermore, the particular features, structures, materials, or characteristics may be combined in any suitable manner in one or more embodiments or examples. In addition, the different embodiments or examples described in the specification or the features in the different embodiments or examples can be united or combined by those skilled in the art in conditions without contradictory.

Although explanatory embodiments have been shown and described, it would be appreciated by those skilled in the art that various changes, alternatives, variations and modifications can be made in the embodiments without departing from spirit, principles of the present disclosure. The scope of the present disclosure is defined by the claims and its equivalents.

What is claimed is:

1. A refrigerator, comprising:

a freezing air channel assembly; and a refrigerating air channel assembly, wherein each of the freezing air channel assembly and the refrigerating air channel assembly is an air channel assembly including:

a casing provided with an air supply channel and a drainage port therein, the air supply channel having an air inlet and a bottom air supply port;

an air-supply guide portion provided adjacent to the bottom air supply port and configured to lead air to the bottom air supply port, the air-supply guide portion includes a first air-supply guide section connected to the air supply channel; and a second air-supply guide section spaced apart from the first air-supply guide section; and a drainage guide portion provided adjacent to the bottom air supply port and configured to lead water to the drainage port, the drainage guide portion further includes a first drainage guide section connected to the first air-supply guide section; and a second drainage guide section connected to the second air-supply guide section, wherein a guide direction of the air-supply guide portion is opposite to a guide direction of the drainage guide portion, wherein projections of a front side face of the first air-supply guide section and a front side face of a terminal end of the air supply channel in a vertical direction fall onto the second drainage guide section.

2. The refrigerator according to claim 1, wherein the second air-supply guide section is consistent with the first air-supply guide section in their respective air-supply guide directions, the drainage guide portion being located between the first air-supply guide section and the second air-supply guide section and the guide direction of the drainage guide portion is opposite to the guide direction of the first air-supply guide section.

3. The refrigerator according to claim 2, wherein the second drainage guide section is located below the first drainage guide section.

4. The refrigerator according to claim 3, wherein the second air-supply guide section gradually inclines downward from rear to front, and the second drainage guide section gradually inclines downward from front to rear.

5. The refrigerator according to claim 3, wherein the drainage port is defined in the first drainage guide section, and the bottom air supply port is defined above the second air-supply guide section and a guide direction of the bottom air supply port is opposite to the air-supply guide direction of the second air-supply guide section.

6. The refrigerator according to claim 5, further comprising an auxiliary guide portion arranged on the second drainage guide section and having a groove, the groove being arranged adjacent to the drainage port for gathering the water to the drainage port.

7. The refrigerator according to claim 3, wherein there is a gap between a lower end of the first drainage guide section and the second drainage guide section.

8. A refrigerator, comprising:

a freezing air channel assembly; and a refrigerating air channel assembly, wherein each of the freezing air channel assembly and the refrigerating air channel assembly is an air channel assembly including:

a casing provided with an air supply channel and a drainage port therein, the air supply channel having an air inlet and a bottom air supply port;

an air-supply guide portion provided adjacent to the bottom air supply port and configured to lead air to the bottom air supply port; and a drainage guide portion provided adjacent to the bottom air supply port and configured to lead water to the drainage port, wherein a guide direction of the air-supply guide portion is opposite to a guide direction of the drainage guide portion, the air-supply guide portion further comprises:

a first air-supply guide section connected to the air supply channel; and a second air-supply guide section spaced apart from the first air-supply guide section and being consistent with the first air-supply guide section in their respective air-supply guide directions, the drainage guide portion being located between the first air-supply guide section and the second air-supply guide section and the guide direction of the drainage guide portion is opposite to the guide direction of the first air-supply guide section, the drainage guide portion further comprises:

a first drainage guide section connected to the first air-supply guide section; and a second drainage guide section connected to the second air-supply guide section and located below the first drainage guide section, wherein projections of a front side face of the first air-supply guide section and a front side face of a terminal end of the air supply channel in a vertical direction fall onto the second drainage guide section.

9. The refrigerator according to claim 3, wherein a projection of a terminal end of the first drainage guide section on the second drainage guide section is adjacent to a front side of the second drainage guide section.

* * * * *